US010152856B2

(12) United States Patent
Fasone

(10) Patent No.: US 10,152,856 B2
(45) Date of Patent: Dec. 11, 2018

(54) NON-LETHAL WEAPON FIXTURE AND METHOD OF DEFENSE WITH A NON-LETHAL WEAPON

(71) Applicant: Samuel Fasone, Westerville, OH (US)

(72) Inventor: Samuel Fasone, Westerville, OH (US)

( * ) Notice: Subject to any disclaimer, the term of this patent is extended or adjusted under 35 U.S.C. 154(b) by 0 days.

(21) Appl. No.: 15/376,460

(22) Filed: Dec. 12, 2016

(65) Prior Publication Data

US 2017/0169676 A1 Jun. 15, 2017

Related U.S. Application Data

(60) Provisional application No. 62/266,287, filed on Dec. 11, 2015.

(51) Int. Cl.

| | |
|---|---|
| ***G08B 13/14*** | (2006.01) |
| ***F41H 9/10*** | (2006.01) |
| ***F41H 11/00*** | (2006.01) |
| ***A47B 81/00*** | (2006.01) |
| ***G08B 15/02*** | (2006.01) |
| *G08B 15/00* | (2006.01) |

(52) U.S. Cl.

CPC ..... *G08B 13/149* (2013.01); *A47B 81/00* (2013.01); *F41H 9/10* (2013.01); *F41H 11/00* (2013.01); *G08B 15/02* (2013.01); *G08B 15/004* (2013.01)

(58) Field of Classification Search

CPC ..... G08B 13/149; F41H 9/10; F41H 11/00
See application file for complete search history.

(56) References Cited

U.S. PATENT DOCUMENTS

| | | | | | |
|---|---|---|---|---|---|
| 3,145,375 | A * | 8/1964 | Webb | A62C 37/50 | 169/30 |
| 3,893,095 | A * | 7/1975 | DeJong | G08B 13/14 | 169/23 |
| 4,003,048 | A * | 1/1977 | Weise | A62C 13/78 | 340/568.4 |
| 4,125,084 | A * | 11/1978 | Salmonsen | G08B 13/1472 | 116/99 |
| 5,645,129 | A * | 7/1997 | Renna | A62C 13/78 | 169/51 |
| 7,450,020 | B2 * | 11/2008 | McSheffrey | A61N 1/39 | 169/23 |
| 7,891,435 | B2 * | 2/2011 | McSheffrey | A61N 1/39 | 116/67 R |
| 9,482,496 | B1 * | 11/2016 | Rocchi | F41H 9/04 | |
| 2004/0065451 | A1 * | 4/2004 | McSheffrey | A61N 1/39 | 169/75 |
| 2006/0283608 | A1 * | 12/2006 | Hauck | A62C 13/00 | 169/30 |
| 2016/0012701 | A1 * | 1/2016 | Lu | F41H 9/10 | 222/183 |
| 2016/0018194 | A1 * | 1/2016 | Childs | F41H 9/10 | 222/173 |

* cited by examiner

*Primary Examiner* — Joseph Feild
*Assistant Examiner* — Rufus Point
(74) *Attorney, Agent, or Firm* — Ice Miller LLP

(57) ABSTRACT

A non-lethal weapon fixture and a method of defense with a non-lethal weapon are provided. The non-lethal weapon fixture includes a carrier having a contact point and a separation indicator connected to the carrier. The contact point is configured to interface with a non-lethal weapon. A separation signal is transmitted by the separation indicator upon separation of the non-lethal weapon from the carrier.

12 Claims, 3 Drawing Sheets

NON-LETHAL WEAPON FIXTURE AND METHOD OF DEFENSE WITH A NON-LETHAL WEAPON

BACKGROUND

Building occupants and those assembled at a location face increasing threats to their safety. For example, active shooters continue to target larger private and publicly accessible locations, such as school classrooms, to cause death and serious bodily harm to those gathered at the location. Community leaders suggest that firearms or similar deadly weapons be placed at each location to provide the occupants of such spaces a defense against threats. However, a defensive strategy involving firearms possessed by teachers or other authority figures presents serious concerns upon practical implementation. First, the safety of everyone at the location is immediately and continually compromised because a deadly weapon becomes reasonably accessible by everyone. Second, the weapon custodian must receive extensive training for the guarding, handling, and using of the weapon to prevent unnecessary injury or death to building occupants. Moreover, the user of a deadly weapon, such as a teacher, and any observer, including any children present, will experience extreme trauma caused by the serious injury to or killing of a person. Finally, providing a weapon without any additional means to alert security or law enforcement officials does not adequately defend against many violent threats, such as active shooters carrying larger weapons.

Therefore, there exists a need in the art for a non-lethal weapon fixture that provides a defensive measure against human or animal threats. Further, there exists a need in the art for a weapon fixture that eliminates the threat of death or serious bodily harm by the weapon upon access to the weapon by a person, threatening or innocuous. Finally, there exists a need in the art for a weapon fixture that provides a separation signal to indicate that an emergency event is occurring when the weapon is being used.

SUMMARY

In accordance with an embodiment of the present disclosure, a non-lethal weapon fixture is provided. The non-lethal weapon fixture includes a carrier having a contact point and a separation indicator connected to the carrier. The contact point is configured to contact a non-lethal weapon. A separation signal is transmitted by the separation indicator upon separation of the non-lethal weapon from the carrier.

The non-lethal weapon fixture may further include a non-lethal weapon contacting the carrier at the contact point. The non-lethal weapon may be pepper spray. The carrier may comprise an enclosure configured to contain the non-lethal weapon. The enclosure may include at least one transparent portion to permit viewing of the non-lethal weapon from a location outside of the enclosure. The separation indicator may include an electrical circuit to transmit a separation signal. The electrical circuit may be openable based upon the contact of the carrier at the contact point with the non-lethal weapon. The electrical circuit may be open when the non-lethal weapon is in contact with the carrier at the contact point. The electrical circuit may be closed when the non-lethal weapon is in contact with the carrier at the contact point. The separation signal may include an audible alert. The separation indicator may transmit the audible alert from a remote location relative to the carrier upon separation of the non-lethal weapon from the carrier. The separation signal may include an emergency signal transmitted by the separation indicator to a remote emergency signal receiver to indicate separation of the non-lethal weapon from the carrier.

In accordance with a further embodiment of the present disclosure, a method of defense with a non-lethal weapon is provided. The method includes positioning the non-lethal weapon at a carrier such that the carrier contacts the non-lethal weapon at a contact point, and transmitting a separation signal upon separation of the carrier from the non-lethal weapon at the contact point.

Transmitting the separation signal may include transmitting an audible alert. Transmitting the audible alert may include transmitting the audible alert from a remote location relative to a location of the carrier upon separation of the non-lethal weapon from the carrier. The method may further include enclosing the non-lethal weapon in the carrier to contain the non-lethal weapon within the carrier. The method may further include maintaining an electrical circuit at least partially through the contact point such that transmitting the separation signal occurs upon the opening of the electrical circuit through the contact point. Transmitting the separation signal may include transmitting the separation signal to a remotely located non-lethal weapon fixture. Transmitting the separation signal may include transmitting the separation signal to a plurality of remotely located non-lethal weapon fixtures. The method may further include receiving the separation signal at a signal receiver and transmitting a second signal from the signal receiver to a remote location. The method may further include receiving the separation signal at a signal receiver and transmitting a security signal to at least one building actuation module. The method may further include transmitting the separation signal to a location within a room containing the carrier and transmitting an audible alert from the location upon separation of the non-lethal weapon from the carrier.

BRIEF DESCRIPTION OF THE FIGURES

The embodiments described herein and other features, advantages, and disclosures contained herein, and the manner of attaining them, will be better understood from the following description in conjunction with the accompanying drawing figures, in which like reference numerals identify like elements, and wherein.

DETAILED DESCRIPTION

In the following detailed description of embodiments of the present disclosure, reference is made to the accompanying drawings that form a part hereof, and in which is shown by way of illustration, and not by way of limitation, such specific embodiments. It is to be understood that other embodiments may be utilized and that changes may be made without departing from the spirit and scope of the present disclosure.

Figure 1:
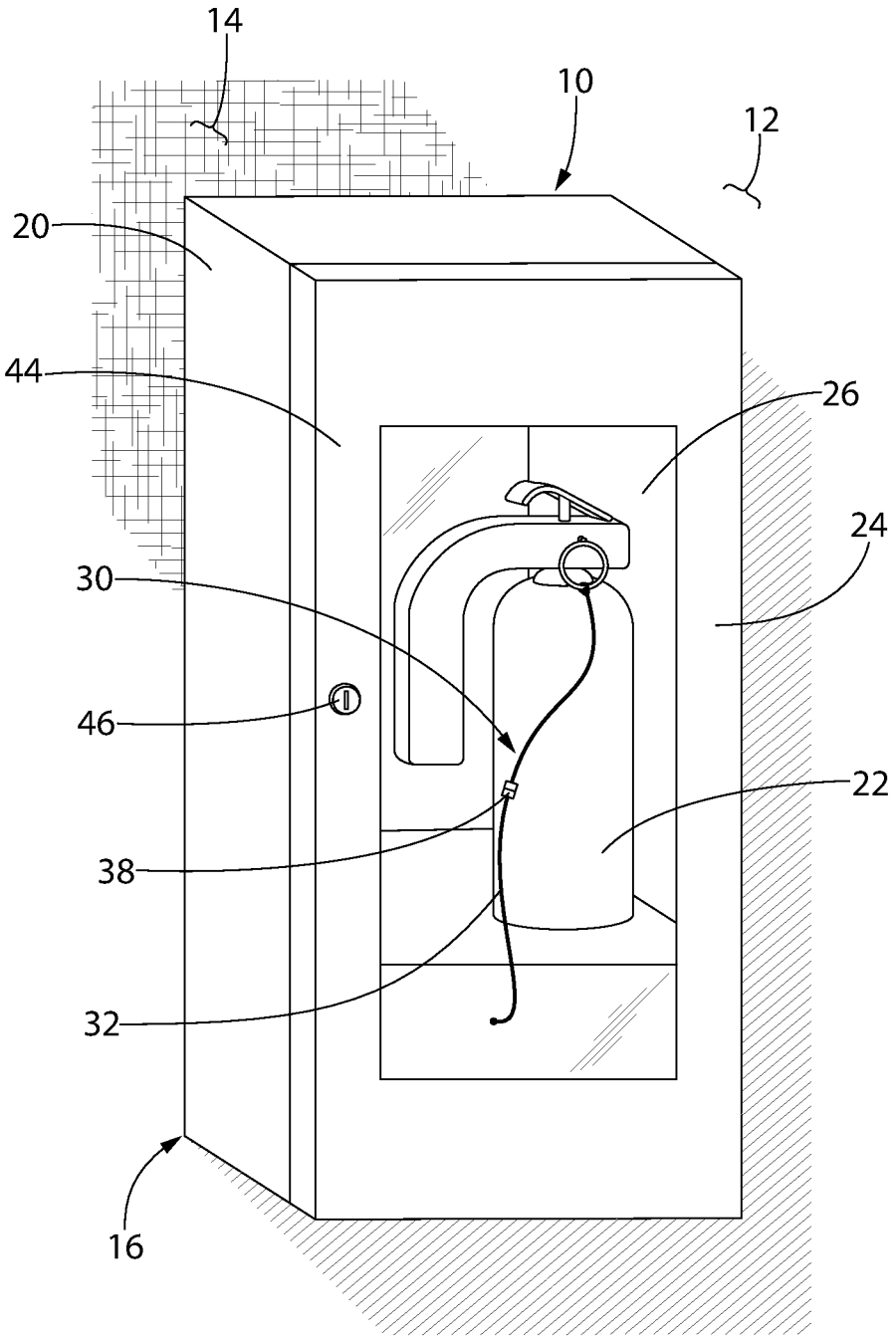
FIG. 1 is a perspective view of a non-lethal weapon fixture in accordance with aspects of the present disclosure.

Reference is now made to FIG. 1, which discloses a fixture 10 in accordance with one or more embodiments of the present disclosure. The fixture 10 of the embodiment illustrated in FIG. 1 is mounted to a wall 12 of a building structure 14. In additional embodiments, the fixture 10 is mounted into the wall 12, into a ceiling, or into a floor of the building structure 14. A lowest point 16 of the fixture 10 of the embodiment of FIG. 1 is mounted at or above a minimum height, such as a height of four feet from the floor. In further embodiments not illustrated, the fixture 10 may be mounted to a vehicle surface, a furniture surface, or any other surface or positioned on the surface of a floor or another surface.

The fixture 10 of FIG. 1 includes a carrier 20. The carrier 20 of one or more embodiments includes a box, enclosure, or container configured to contain a non-lethal weapon 22. The weapon 22 of one embodiment includes a spray, such as an irritant, immobilizing, deterring, repelling, and/or disabling spray such as pepper spray, oleoresin capsicum (OC) spray, or mace to name several non-limiting embodiments. The weapon 22 is any non-lethal weapon in additional embodiments. In additional embodiments, the weapon 22 is capable of deadly force, such as a firearm. FIG. 1 further illustrates the carrier 20 including a front panel 24 having a transparent portion 26. The transparent portion 26 permits viewing of the weapon 22 from a location outside of the carrier 20. In one embodiment, the transparent portion 26 includes break glass or a breakable barrier. In one or more embodiments, a larger portion of the carrier 20 or the entire carrier 20 is transparent to allow improved perception of the weapon 22 inside of the carrier 20. In an embodiment not illustrated, the carrier 20 is opaque or not transparent to prevent perception of the weapon 22 or another object inside of the carrier 20. The carrier 20 of one or more embodiments includes a square, rectangular, triangular, cylindrical, spherical, or any other structurally-shaped enclosure.

The carrier 20 includes a contact point 30 interfacing with the weapon 22. The contact point 30 of the embodiment of FIG. 1 is a tether 32 connecting the carrier 20 to the weapon 22. The tether 32 includes a connection point 38 that allowed separation of the weapon 22 from the carrier 20. The connection point 38 is connected to or forms part of a separation indicator 40, discussed in further detail below. The contact point 30 does not physically contact the weapon 22 in one or more embodiments, but rather interfaces with the weapon 22. In one non-limiting example, the weapon 22 interfaces with the carrier 20 at the contact point 30, and the separation indicator 40 determines separation of the weapon 22 from the carrier 20 by sensing, such as by RFID or infrared, the separation of the weapon 22 from the carrier 20. One will recognize that the term "contacting" and the term "interfacing" may be used interchangeably throughout the embodiments of the present disclosure as permitted by the various sensing and indicating structures and methods described herein.

The carrier 20 includes an openable door 44 or window in one or more embodiments. The openable door 44 or window includes an access control device 46 in an embodiment. The access control device 46 of one embodiment includes a locking mechanism. The locking mechanism may be unlockable by a key, combination mechanism, keypad, RFID device, or remotely transmitted unlock signal sent to the access control device 46.

Figure 2:
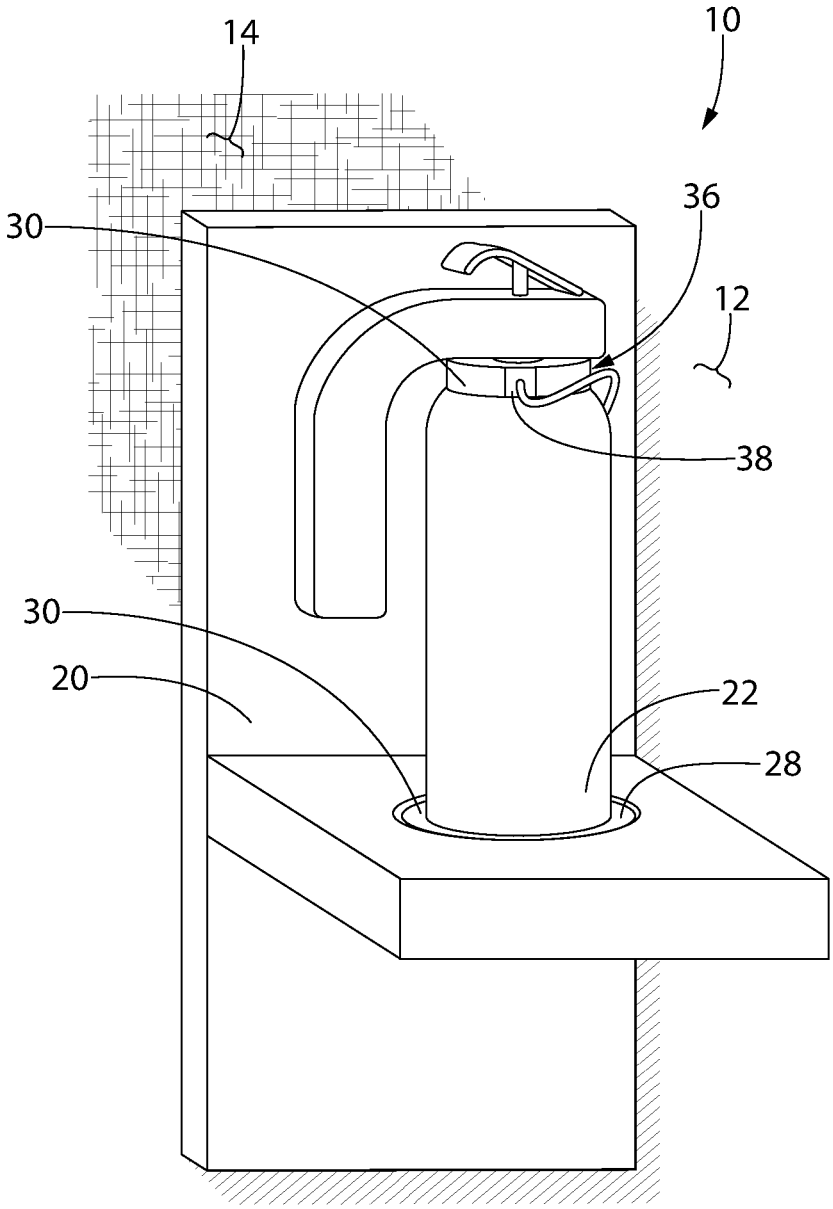
FIG. 2 is a perspective view of a non-lethal weapon fixture in accordance with aspects of the present disclosure.

Referring now to FIG. 2, in one embodiment, the carrier 20 does not enclose the weapon 22. The contact point 30 of an additional embodiment includes the connection point 38 attached to a neck 36 of the weapon 22. The connection point 38 attached to the neck 36 allows separation of the weapon 22 by breaking, opening, or otherwise manipulating the connection point 38 to release the weapon 22 in an embodiment. In such an embodiment, the contact point 30 is physically coupled to the carrier 20 to detect separation of the weapon 22 from the carrier 20. The contact point 30 of any embodiment disclosed herein is connected to or forms part of a separation indicator 40, discussed in further detail below.

The carrier 20 of an embodiment includes a weapon support surface 28 that includes the contact point 30 to contact the weapon 22. The weapon support surface 28 may exist to replace or as a redundant feature to any other contact point 30 disclosed herein. In an embodiment, the contact point 30 is a pressure or weight sensitive surface on or in the carrier 20 that senses contact between the carrier 20 and the weapon 22. In a further embodiment, the contact point 30 is a proximity sensor or other sensor of similar functionality, such non-limiting examples being a capacitive sensor, photoelectric sensor, inductive sensor, infrared sensor, Doppler effect sensor, magnetic sensor, photocell sensor, radar sensor, ultrasonic sensor, electromagnetic sensor, RFID sensor, or Hall effect sensor.

Figure 3:
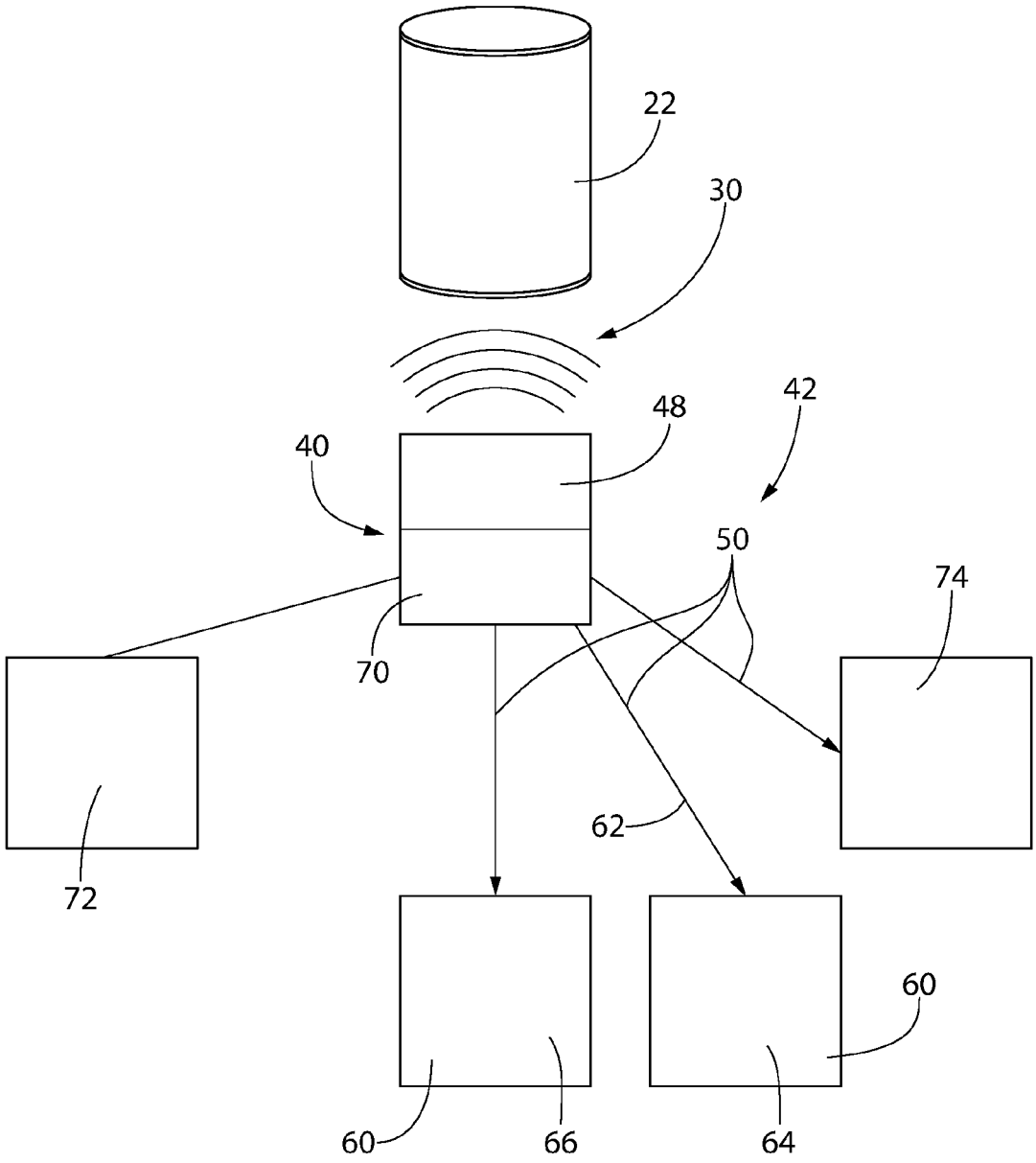
FIG. 3 is a schematic view of a non-lethal weapon fixture of a non-lethal weapon fixture in accordance with aspects of the present disclosure.

Referring now to FIG. 3, the fixture 10 of FIGS. 1 and 2 further includes the separation indicator 40 that is connected to the carrier 20. The separation indicator 40 is connected to the carrier 20. The separation indicator 40 includes a sensor 48 in one or more embodiments, such as those discussed above with regard to the contact point 30. The sensor 48 of one or more embodiments includes a weight sensor, a proximity sensor, or a switch. The sensor 48 is coupled to, connected to, or capable of sensing the general position or attachment of the weapon 22 relative to the carrier 20.

When the weapon 22 is separated from the carrier 20, the separation indicator 40 transmits a separation signal 50. The separation indicator 40 includes an electrical circuit 42 to transmit the separation signal 50. The circuit 42 of one embodiment is openable based upon the contact of the carrier 20 at the contact point 30 with the weapon 22. In one embodiment, the electrical circuit 42 is open when the weapon 22 is in contact with the carrier 20 at the contact point 30. In another embodiment, the circuit 42 is closed when the weapon 22 is in contact with the carrier 20 at the contact point 30.

The separation indicator 40 includes a controller 70 and includes or is connected to a power source 72 in one or more embodiments. The power source 72 may be direct current (DC) or alternating current (AC). In one embodiment, the power source 72 is the AC supply of the building 14. In another embodiment, the power source 72 is DC power supplied from a battery in or near the carrier 20. In one or more embodiments, the battery is a lithium ion or lithium polymer battery. In one embodiment, the power source 72 is the AC supply of a building 14. In additional embodiments, the power source 72 is a combination of AC and DC power, and/or one or more solar, wind, or other alternative and/or renewable energy sources.

The separation signal 50 is supplied to a transducer, such as a speaker 74 in a non-limiting example, or similar device capable of providing an audible alarm in one embodiment. The speaker 74 may be located at or on the carrier 20, separated from the carrier 20 by ten feet or more yet within the same room or area as the carrier 20, or located in another area of the building 14 or at a location outside of the building 14. In an embodiment, the separation signal 50 is transmitted as an emergency signal 62 to a remote emergency signal receiver 64 at a remote location 60, as discussed in more detail below. The separation signal 50 is transmitted to a building signal receiver 66 in a further embodiment, as discussed in more detail below.

When the weapon 22 is not in contact with the carrier 20 at the contact point 30, the separation signal 50 is transmitted. The separation signal 50 in an embodiment is an audible alert, such as an alarm or audible voice alert. The audible voice alert may include verbal instructions to listeners relating to an emergency or other event. In an embodiment, the separation indicator 40 includes a time delay module to delay transmitting of the separation signal 50 or delay operation of the speaker 74.

The audible alert may be transmitted to and/or from the remote location 60. In such an embodiment, the separation indicator 40 transmits the separation signal 50 in the form of an electrical signal to the remote location 60. The separation signal 50 may then be transmitted in the form of an audible alert or other signal from the remote location 60. In such an embodiment, the audible alert transmitted from the remote location 60 may act as a distraction to a threat, such as an attacker or active shooter. In an embodiment, the separation indicator 40 transmits the separation signal 50 as the emergency signal 62 to the remote emergency signal receiver 64 to indicate separation of the weapon 22 from the carrier 20. One will recognize that the separation signal 50 may include a single signal or a plurality of separate signals originating from the separation indicator 40 such that each of the separate signals takes the form of one or more audible, emergency, actuation, and/or other signal types including, without limitation, an audible signal, a hardwired electrical signal, a wireless electrical signal, a visual signal, such as a light signal, a radio signal, a mechanical signal or any other signal type that one having ordinary skill utilizes for the purpose of indicating.

The separation indicator 40 also transmits, in an embodiment, a separation signal 50 to the building signal receiver 66 to actuate emergency or security procedures. Such emergency or security procedures are operated by building actuation modules and include, without limitation, closing, opening, locking, or unlocking of doors and/or windows, activating an external and/or remote alarm, activating or deactivating lighting or electrical power to one or more areas of the building 14, activating a sprinkler or fire suppression system, or activating one or more barriers or gates. In particular embodiments, the separation indicator 40 transmits a separation signal 50 to one or more emergency lights, such as a strobe light. The one or more emergency lights are located on or in the carrier 20, in the same room as the carrier 20, in a different area of the building 14 from the carrier 20, or at a location outside of the building 14 in one or more embodiments.

The separation signal 50 to any device described above and any signal received from the remote location 60 may be transmitted by wired or wireless connection. In the case of a wireless connection to the remote emergency signal receiver 64, the remote location 60, and/or the building signal receiver 66, any of the remote emergency signal receiver 64, the remote location 60, or the building signal receiver 66 may include a separate controller (not shown). Further, any of the remote emergency signal receiver 64, the remote location 60, or the building signal receiver 66 may include or may be connected to a separate power source. The power source (not shown) may be DC or AC. In one embodiment, the power source is the AC supply of a building 14. In another embodiment, the power source is DC power supplied from a battery, such as a lithium battery in one non-limiting example. In additional embodiments, the power source is a combination of AC and DC power, and/or one or more solar, wind, or other alternative and/or renewable energy sources.

In an additional embodiment not illustrated, multiple carriers 20 are disposed at, in, and/or around the building 14 or within a particular group of structures and/or outdoor areas. The multiple carriers 20 are communicatively linked and/or otherwise capable of transmitting one or more signals to each other and/or a central hub. In such embodiments, the transmission of a signal from one of the multiple carriers 20, such as by the separation signal 50, may result in the signal or transmission of an alert or other event at the one or more additional carriers 20, a locking, unlocking, or modification of accessibility to the one or more additional carriers 20. Further, each carrier 20 in the embodiment having multiple carriers 20 may include the structures, functions, and/or features described above with regard to embodiments having a single carrier 20.

The present disclosure provides the fixture 10 as a defensive measure against human or animal threats. The fixture 10 acts as a deterrent to prevent human threats such as those engaging in violent or dangerous acts, including active shooters and armed burglars. The fixture 10 further provides a defensive weapon against humans or animals that threaten the safety of building occupants. Further, the fixture 10 provides building occupants or a large assembly of people with a defensive measure against the threat of a dangerous animal, such as an aggressive dog or a bear.

The connectivity of the fixture 10 provides immediate or delayed alerts to the local area and/or remote locations in the form of an alarm, building actuations, or emergency alerts, as discussed above, to enable building occupants and security or law enforcement officials to be aware of the event or threat and take immediate action necessary to prevent or end the triggering event. Further, should a threatening or innocuous person gain access to the weapon 22, the non-lethal nature of the weapon 22 contained in the fixture 10 in one or more embodiments of the present disclosure prevents the death or serious bodily harm to any other building occupant upon use of the weapon 22. Additionally, when the user of the weapon 22 operates the weapon 22, such as a teacher in a classroom using a pepper spray canister as described in one embodiment, the user and any observer, such as any children in the school, will not experience the same degree of trauma as that associated with the use of a deadly weapon to kill or seriously injure a threat. The fixture 10 provides a defensive measure for occupants of any public building or indoor/outdoor assembly location, including without limitation a school, government building such as a courthouse, airport, train station, office building, shopping mall, retail store, sports/entertainment arena or stadium, museum, movie theatre, or restaurant.

While particular embodiments of the present disclosure have been illustrated and described, it would be obvious to those skilled in the art that various other changes and modifications can be made without departing from the spirit and scope of the present disclosure. It is therefore intended to cover in the appended claims all such changes and modifications that are within the scope of this disclosure.

What is claimed is:

1. A non-lethal weapon fixture, comprising:

a carrier having a time delay module, a weapon support surface, and having a contact point to be located within a room in a building;

a non-lethal weapon being supported by the weapon support surface and contacting the carrier at the contact point;

a separation indicator connected to the carrier, wherein a separation signal is transmitted upon separation of the non-lethal weapon from the carrier at the contact point;

wherein the time delay module delays transmission of the separation signal by a predetermined amount of time;

wherein the contact point is pressure sensitive;

wherein the non-lethal weapon is an irritant spray; and wherein the separation signal is capable of initiating an audible signal from a location greater than ten feet from the carrier and within the room.

2. The non-lethal weapon fixture of claim 1, wherein the separation indicator includes an electrical circuit to transmit a separation signal, the electrical circuit being openable based upon the contact of the carrier at the contact point with the non-lethal weapon.

3. The non-lethal weapon fixture of claim 2, wherein the electrical circuit is open when the non-lethal weapon is in contact with the carrier at the contact point.

4. The non-lethal weapon fixture of claim 2, wherein the electrical circuit is closed when the non-lethal weapon is in contact with the carrier at the contact point.

5. A non-lethal weapon fixture, comprising:

a carrier to be located in a building and having a weapon support surface, a contact point, and a time delay module;

a non-lethal weapon to be supported by the weapon support surface and to contact the carrier at the contact point;

a central hub;

wherein the carrier wirelessly transmits a separation signal to the central hub upon separation of the non-lethal weapon from the carrier at the contact point;

wherein the time delay module delays transmission of the separation signal from the carrier to the central hub by a predetermined amount of time;

wherein the central hub transmits a signal to a signal receiver remote to the building upon receiving the separation signal from the carrier;

wherein a building signal receiver is capable of automatically actuating emergency security procedures after the non-lethal weapon is separated from the carrier at the contact point; and wherein the emergency security procedures include closing, opening, locking, or unlocking one or more doors, barriers, or windows.

6. The non-lethal weapon fixture of claim 5, wherein the building signal receiver automatically actuates the emergency security procedures upon receiving a separation signal from the carrier.

7. The non-lethal weapon fixture of claim 5, wherein the building signal receiver automatically actuates the emergency security procedures upon receiving a signal from the central hub.

8. The non-lethal weapon fixture of claim 5, wherein the emergency security procedures further include activating or deactivating lighting or electrical power to at least a portion of the building.

9. A non-lethal weapon fixture, comprising:

a carrier to be located in a building and having a weapon support surface, a contact point, and a time delay module;

a non-lethal weapon to be supported by the weapon support surface and to contact the carrier at the contact point;

a central hub;

wherein the carrier wirelessly transmits a separation signal to the central hub upon separation of the non-lethal weapon from the carrier at the contact point;

wherein the central hub transmits a signal to a signal receiver remote to the building upon receiving the separation signal from the carrier;

wherein the time delay module delays transmission of the separation signal from the carrier to the central hub by a predetermined amount of time.

10. The non-lethal weapon fixture of claim 9, further comprising an enclosure that encloses the non-lethal weapon in the carrier to contain the non-lethal weapon within the carrier.

11. The non-lethal weapon fixture of claim 10, wherein the enclosure includes a breakable barrier.

12. The non-lethal weapon fixture of claim 11, wherein breaking the breakable barrier does not trigger transmission of the separation signal from the carrier to the central hub.

* * * * *